United States Patent [19]

Asano et al.

[11] 4,175,530

[45] Nov. 27, 1979

[54] PNEUMATIC GOVERNOR CONTROL APPARATUS FOR ENGINE FUEL INJECTION SYSTEM

[75] Inventors: Eijiro Asano; Ryuichi Komori, both of Higashi-Matsuyama, Japan

[73] Assignee: Diesel Kiki Co., Ltd., Tokyo, Japan

[21] Appl. No.: 870,661

[22] Filed: Jan. 19, 1978

[30] Foreign Application Priority Data

Jan. 21, 1977 [JP] Japan ..... 52-6140[U]

[51] Int. Cl.[2] ..... F02D 1/04

[52] U.S. Cl. ..... 123/140 FG; 123/140 MC; 123/140 R

[58] Field of Search ..... 123/140 FG, 140 MC, 123/140 MP, 140 R, 32 EA

[56] References Cited

U.S. PATENT DOCUMENTS

| | | | |
|---|---|---|---|
| 2,817,325 | 12/1957 | Meissner | 123/140 MP |
| 2,884,918 | 5/1959 | Klug | 123/140 MP |
| 2,899,952 | 8/1959 | Zechnall et al. | 123/140 MP |
| 3,142,291 | 7/1964 | Bostwick | 123/140 MP |
| 3,605,711 | 9/1971 | Fuso | 123/140 MC |
| 3,664,319 | 5/1972 | Channing | 123/140 MC |
| 3,916,861 | 11/1975 | Akashi et al. | 123/140 MC |
| 4,082,066 | 4/1978 | Long | 123/32 EA |
| 4,095,573 | 6/1978 | Kollmann | 123/140 MP |

*Primary Examiner*—Charles J. Myhre
*Assistant Examiner*—P. S. Lall
*Attorney, Agent, or Firm*—David G. Alexander

[57] ABSTRACT

An engine driven air pump produces a vacuum having a magnitude or level which increases with engine speed. The air pump is connected to a pneumatic governor which varies the volume of fuel injected into the engine by a fuel injection pump in accordance with the level of vacuum. A control valve variably communicates the inlet of the governor with the atmosphere to control the level of vacuum. A high speed valve connected in series with the control valve progressively closes when the engine speed exceeds a predetermined maximum value. A shut-off valve connected in series with the control valve closes when an engine on-off switch is turned off.

10 Claims, 10 Drawing Figures

PNEUMATIC GOVERNOR CONTROL APPARATUS FOR ENGINE FUEL INJECTION SYSTEM

BACKGROUND OF THE INVENTION

The present invention relates to an improved pneumatic governor control apparatus for an engine fuel injection system.

It is common to provide Diesel engines with fuel injection systems which are controlled by pneumatic governors. The governor is connected to a venturi which is provided upstream of the engine intake manifold in the air induction passageway. The vacuum in the venturi is applied to a diaphragm in the governor which controls the amount of fuel injected into the engine by a fuel injection pump in accordance with the level of vacuum.

In addition to generally inaccurate fuel injection control, such an arrangement suffers from several serious drawbacks.

1. The venturi constricts the air induction passageway during high load, high speed engine operation to such an extent as to degrade the air induction efficiency and engine output power.

2. Whereas in a gasoline engine provided with an electric ignition system, the engine may be easily shut off by merely de-energizing the ignition system, in a Diesel engine either the fuel or air supply must be shut off. This is because the engine automatically draws fuel and air into the induction passageway as a consequence of operation. It is therefore relatively difficult to stop a Diesel engine quickly.

3. Where exhaust gas recirculation is incorporated to reduce the emission of pollutants, variations of pressure in the intake manifold make it difficult to accurately sense the exhaust gas pressure which varies in accordance with engine load.

SUMMARY OF THE INVENTION

The present invention overcomes the problems of the prior art by eliminating the venturi which is commonly used to produce vacuum for operating a pneumatic governor and providing an air pump driven by the engine to serve this function. A series of air valves variably bleed air into the inlet of the governor and thereby control the level of vacuum. The level of vacuum produced by the air pump increases with engine speed, thereby constituting a control parameter which is independent of the adverse effects of a venturi in the air induction passageway. One of the valves is electrically actuated by a key switch to terminate the air bleed and thereby shut off the fuel supply.

It is an object of the present invention to provide an improved fuel injection control apparatus which does not degrade high speed, high load engine operation.

It is another object of the present invention to provide a fuel injection system comprising novel means for shutting off fuel injection and thereby a Diesel engine by merely turning off a key switch.

It is another object of the present invention to provide a fuel injection apparatus which is compatible with an exhaust gas recirculation system.

It is yet another object of the present invention to provide an improved fuel injection apparatus which is compact, and inexpensive to manufacture and install.

It is another object of the present invention to provide a generally improved fuel injection apparatus.

Other objects, together with the foregoing, are attained in the embodiments described in the following description and illustrated in the accompanying drawing.

DESCRIPTION OF THE PREFERRED EMBODIMENTS

While the fuel injection apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
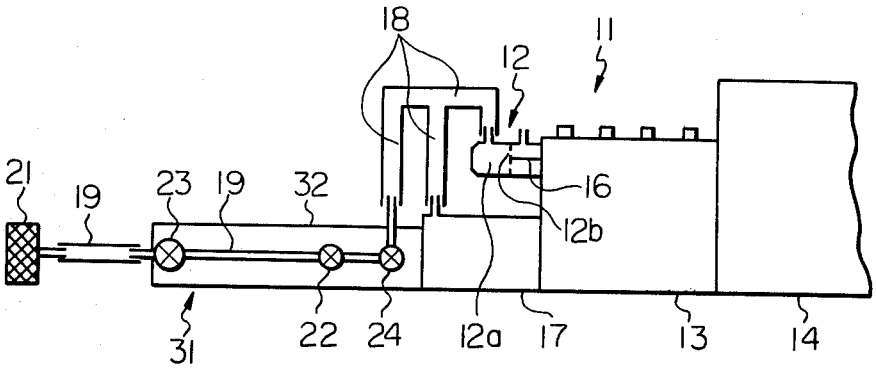
FIG. 1 is a schematic view of a fuel injection system embodying the present invention.

Referring now to FIG. 1 of the drawing, a fuel injection system embodying the present invention is generally designated as 11 and comprises a pneumatic governor 12. The governor 12 is connected to control a fuel injection pump 13 which injects fuel into an internal combustion engine 14, typically of the Diesel type. The governor 12 comprises a housing **12*a* in which is provided a diaphragm 12*b*. The interior of the housing 12*a* rightwardly of the diaphragm 12*b* is exposed to atmospheric pressure. The diaphragm 12*b* is connected to the fuel injection pump 13 through a control rack 16**.

The interior of the housing **12*a* leftwardly of the diaphragm 12*b* is connected to an outlet of an air pump 17 through a first passageway or hose 18. The air pump 17 is driven from the engine 14 or a camshaft (not shown) of the fuel injection pump 13 at a speed proportional to the rotational speed of the engine crankshaft. The air pump 17 produces a vacuum, the magnitude or level of which increases as the engine speed increases. The vacuum from the air pump 17 is applied to the diaphragm 12*b* through the hose 18 to position the diaphragm 12*b* and thereby the control rack 16 in accordance with the level of vacuum. The amount of fuel injected into the engine 14 by the fuel injection pump 13 depends on the position of the control rack 16**. Therefore, the amount of fuel injection depends on the engine speed. As the engine speed and level of vacuum increase, the amount of fuel injection decreases.

The system 11 further comprises a second passageway or hose 19 which connects the hose 18 and thereby the inlet of the governor 12 to the atmosphere through an air cleaner 21. A control valve 22 is provided in the hose 19 to control the amount of air flow through the hoses 19 and 18 and air pump 17 back to the atmosphere in a variable manner.

Figure 2:
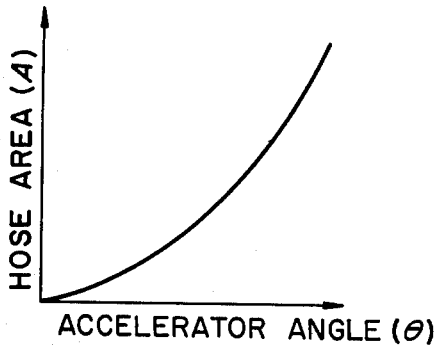
FIGS. 2, 3 and 4 are graphs illustrating the operation of the present fuel injection system.

The valve 22 is connected to an accelerator pedal (not shown) for manual control by the engine operator. The amount of air bled into the hose 18 and governor 12 through the hose 19 also affects the level of vacuum in the governor 12 and thereby the amount of fuel injection. The more open the valve 22 and the greater the amount of air bleed, the lower the level of vacuum and the higher the amount of fuel injection. The greater the degree of depression of the accelerator pedal, designated as $\theta$, the greater the degree of opening of the valve 22. The degree of opening of the valve 22 as a function of $\theta$ is illustrated in FIG. 2, where the effective area of the hose 19 afforded by the valve 22 is designated as A.

Figure 3:
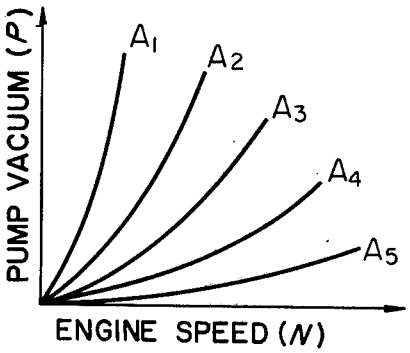

The operation of the air pump 17 is illustrated in FIG. 3 for various values of $\theta$ and thereby A. A curve A1 indicates almost complete closure of the valve 22, and a small amount of fuel injection such as during engine idle. A curve A5 indicates high speed operation. It will be noted that the level of vacuum P increases as the engine speed N increases, to an extent determined by the degree of opening of the valve 22.

Figure 4:
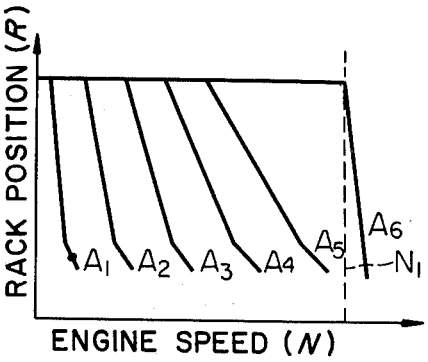

FIG. 4 shows the position of the fuel control rack 16 as a function of engine speed N for the same degrees of opening of the valve 22 illustrated in FIG. 3. The position of the rack 16 is designated as R and corresponds to the amount of fuel injection.

It will be noted that the angle of inclination of the curve A5 in FIG. 4 is less than that of the curve A1, and that the angle of inclination progressively decreases from the curves A1 to A5. This is due to the fact that the air pump 17 does not operate as efficiently at very high speed. This means that the response of the governor 12 to an increase in speed progressively decreases as the engine speed increases.

In order to overcome this problem, a high speed control valve 23 is provided in the hose 19 in series with the valve 22. The valve 23 is normally open and is progressively closed by a flyweight assembly (see FIG. 5) as the engine speed exceeds a predetermined maximum value N1. This produces a very steep curve A6 and sharply increased response of the system 11 at high speed and positively prevents overspeeding of the engine 14.

In order to quickly and effectively shut off the engine 14, a solenoid shut-off valve 24 is provided in the hose 19 in series with the valves 22 and 23. The valve 24 is normally closed and is opened in response to an electrical voltage applied thereto when an engine on-off key switch (not shown) is closed. The valve 24 has no effect on the operation of the system 11 with the key inserted in the switch and turned to close the switch. However, to shut off the engine, it is merely necessary to open the key switch. This causes the valve 24 to close and block the hose 19. The air bleed is stopped and the full vacuum output of the air pump 17 is applied to the governor 12. This causes the rack 16 to be moved to an off position and terminate fuel injection to stop the engine 14.

Figure 5:
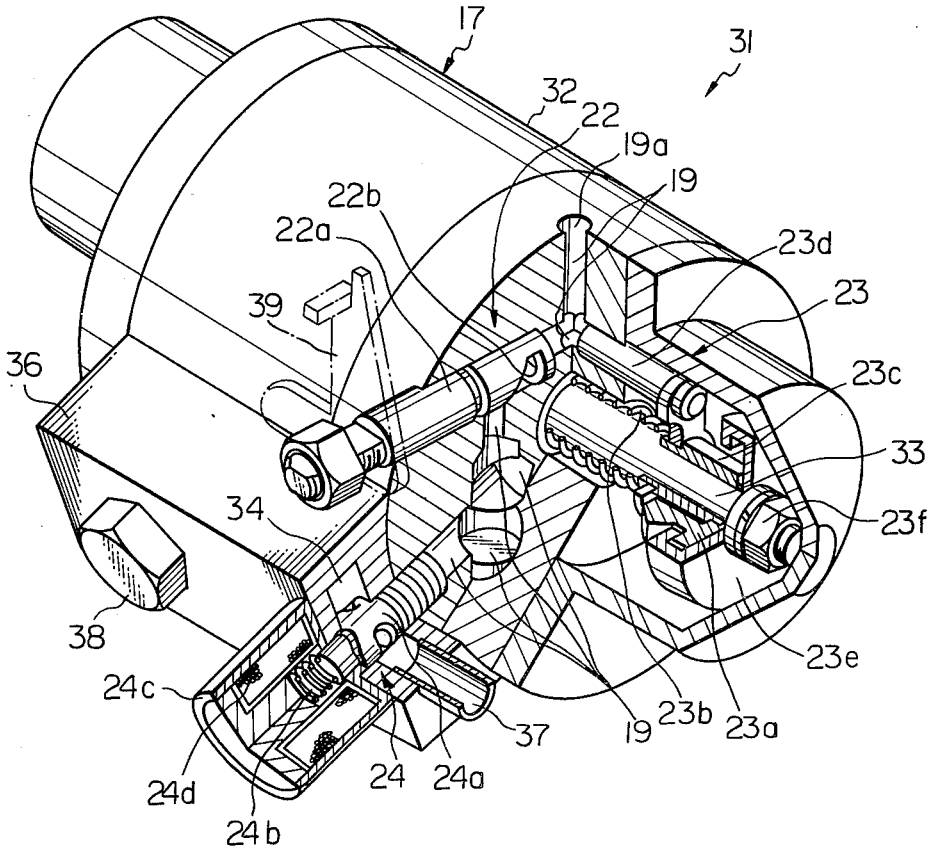
FIG. 5 is a perspective view, partially cut away, of a pneumatic governor control apparatus of the present invention.

Referring now to FIG. 5, the pump 17 and valves 22, 23 and 24 are constructed as an integral unit 31 which comprises a bored housing 2. The pump 17 is not shown in detail but is preferably embodied as a rotary vane pump of the general type disclosed in U.S. Pat. No. 2,046,873. The pump 17 is driven through a camshaft 33 of the fuel injection pump 13 which is in turn driven from the engine 14. The vacuum outlet of the pump 17 communicates through a passageway 34 of a connecting block 36 and an outlet fitting 37 with the hose 18, although the connection is not illustrated in FIG. 5. The passageway 34 extends through a bore of an access nut 38, although not visible in the drawing.

The portion of the hose or passageway 19 extending through the housing 32 is constituted by a passageway which is also designated as 19 in FIG. 5 and has an inlet **19*a* which communicates with the air cleaner 21 through the leftward hose portion of the hose or passageway 19 as viewed in FIG. 1. The valve 22 comprises a rotary valve element 22*a* provided at a right-angle portion of the passageway 19 and which is formed with a helical cutout 22*b*. The end of the valve element 22*a* opposite the cutout 22*b* extends external of the housing 32 and is connected to the accelerator pedal through a manual control arm 39. Depression of the accelerator pedal causes rotation of the arm 39 and valve element 22*a*. The amount of the passageway 19 which is unblocked by the cutout 22*b* corresponds to the angular position of the valve element 22*a*, and thereby corresponds to the effective area of the passageway 19 in the valve 22**.

The valve 23 comprises flyweights **23*a* attached to the camshaft 33 for integral rotation. The flyweights 23*a* are urged by a compression spring 23*b* through a shifter sleeve 23*c* to a radially innermost position. Upon rotation of the camshaft 33 and flyweights 23*a*, the flyweights 23*a* are urged radially outwardly by centrifugal force, thereby exerting a force on the shifter sleeve 23*c* against the force of the spring 23*b* in the upper leftward direction as viewed in FIG. 5. When the centrifugal force exceeds the preload of the spring 23*b*, at the maximum speed N1, the sleeve 23*c* moves in the upper leftward direction to an equilibrium position at which the centrifugal force equals the spring force. Further illustrated is a housing 23*e* for the flyweights 23*a* which is fixed to the camshaft 33 by a nut 23*f***.

The valve 23 further comprises a cylindrical valve element **23*d* connected to the shifter sleeve 23*c* for unitary movement. Movement of the sleeve 23*c* causes the valve element 23*d* to intrude into a right-angle portion of the passageway 19** and block the same to an extent corresponding to the engine speed.

The valve 24 comprises a valve element **24*a* provided where the passageway 19 connects to the passageway 34. The valve element 24*a* is normally urged inwardly to block the passageway 19 by a compression spring 24*b* provided in a housing 24*c* which is fixed to the housing 32. A solenoid coil 24*d* is mounted inside the housing 24*c*. When the solenoid coil 24*d* is energized by turning on an operator controlled key switch, the magnetomotive force of the coil 24*d* pulls the valve element 24*a* thereinto, retracting the valve element 24*a* from the passageway 19** to unblock the same.

Figure 6:
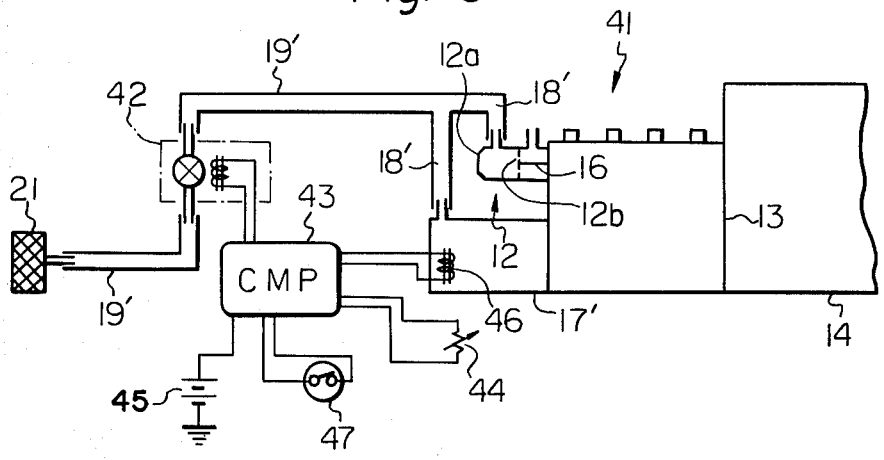
FIG. 6 is similar to FIG. 1 but shows a second embodiment of the invention.
Figure 7:
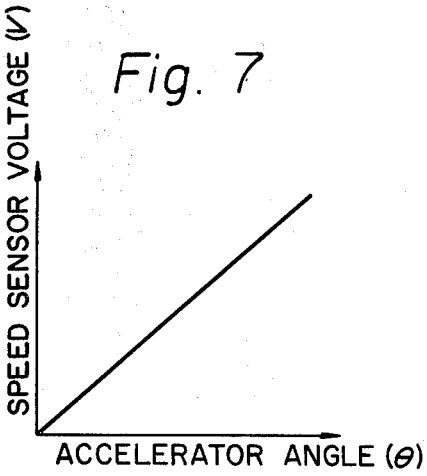
FIGS. 7, 8 and 9 are graphs illustrating the operation of the embodiment of FIG. 6.

FIG. 6 illustrates another fuel injection system 41 of the present invention in which like elements are designated by the same reference numerals and elements which correspond in function but differ in construction are designated by the same reference numerals primed. The system 41 differs from the system 11 in that only one control valve 42 is provided in a second passageway or hose 19'. The valve 42 is of the solenoid type and is normally closed. The valve 42 may be opened in a substantially instantaneous manner by means of an electrical voltage applied thereto from a computing unit 43 which is connected to a voltage source 45. A speed sensor 44 shown as a variable resistor is connected to the accelerator pedal (not shown) to produce an output voltage V as a function of $\theta$ as shown in FIG. 7. A speed sensor 46 such as a tachometer is provided to an air pump 17' to measure the engine speed. The sensors 44 and 46 as well as an operator controlled key switch or on-off switch 47 are connected to the computing unit.

Figure 8:
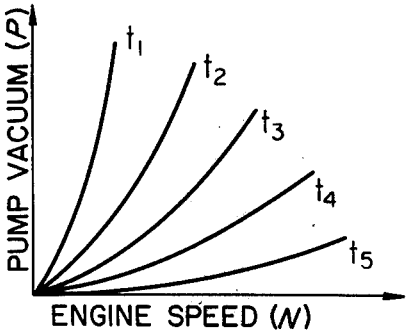
Figure 9:
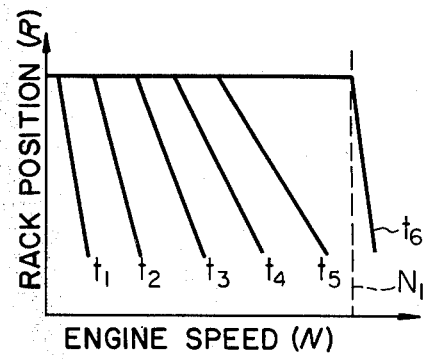

The computing unit 43 gates the voltage of the source 45 to the valve 42 in the form of pulses having variable width. In the absence of any pulses (key switch 47 open), the valve 42 remains closed, the vacuum applied to the governor 12 is maximum and the amount of fuel injection is zero, preventing the engine 14 from running. Assuming a constant pulse repetition frequency, the greater the pulse width the greater the proportion of time the valve 42 is opened, the lower the level of vacuum applied to the governor 12 and the greater the amount of fuel injected into the engine 14. This effect is illustrated in FIG. 8 in which the pulse width is designated as t. A curve t1 corresponds to minimum pulse width, highest level of vacuum P and lowest amount of fuel injection. A curve t5 represents the opposite extreme. The pulse width is determined by the computing unit 43 in accordance with the sensed accelerator position $\theta$ and engine speed N. The corresponding position R of the control rack 16 is illustrated in FIG. 9. The computing unit 43 is further operative to sharply increase the response of the system 41 above the engine speed N1 as indicated by a curve t6 in FIG. 9.

Figure 10:
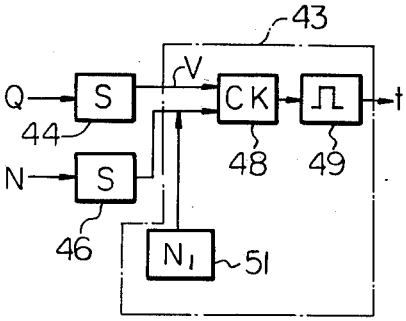
FIG. 10 is a block diagram of an electrical control unit of the embodiment of FIG. 6.

The computing unit 43 is illustrated in FIG. 10 as comprising a computing circuit 48 which receives the outputs of the sensors 44 and 46. The circuit 48 is further responsive to the value of N1 which is stored in a register 51. The output of the circuit 48 is connected to a pulse generator 49 which generates the pulses t. The circuit 48 controls the pulse generator 49 to generate the pulses t in such a manner as to provide the function illustrated in FIG. 9.

In summary, it will be seen that the present system provides the following advantages over the prior art.

1. Due to the elimination of a venturi in the engine air induction passageway, degradation of high speed, high load engine performance is eliminated.
2. The self-contained source of vacuum (air pump) provides accurate control of the amount of fuel injection and is uneffected by pressure changes in the intake manifold even where exhaust gas recirculation is employed.
3. Since only a small volume of air is required for control, the dimensions of the control valve may be greatly reduced over the prior art.
4. Due to the small volume of air required for control, the engine may be quickly and easily stopped merely by opening a key switch.

The flyweight controlled valve 23 in the embodiment of FIGS. 1 to 5 provides the following advantages.

1. The progressive reduction of response of the system at high engine speeds is eliminated.
2. Overspeeding of the engine is made impossible.

The single solenoid valve of the embodiment of FIGS. 6 to 10 provides the following advantages.

1. Since only one valve is required, the size and cost of the apparatus is reduced.
2. Electronic control is extremely accurate.

Various modifications will become possible for those skilled in the art after receiving the teachings of the present disclosure without departing from the scope thereof. For example, the control air pressure may be positive gage pressure rather than vacuum.

What is claimed is:

1. In a fuel injection system for an internal combustion engine having a pneumatic governor which varies an amount of fuel injection in accordance with air pressure applied to the governor, a control apparatus comprising:
   - an engine driven air pump producing an output air pressure corresponding to engine speed;
   - a first passageway connecting the air pump to the governor;
   - a second passageway connecting the first passageway to the atmosphere; and
   - a variable control valve provided in the second passageway.

2. An apparatus as in claim 1, in which the air pump produces the output air pressure as vacuum, a magnitude of the vacuum increasing as the engine speed increases.

3. An apparatus as in claim 1, further comprising a high speed control valve connected in series with said control valve in the second passageway, the high speed control valve being normally open and progressively closing as the engine speed exceeds a predetermined value.

4. An apparatus as in claim 3, in which the high speed control valve comprises a flyweight assembly.

5. An apparatus as in claim 1, further comprising a solenoid valve connected in series with the variable control valve in the second passageway, the solenoid valve being normally closed and opening in response to an electrical voltage applied thereto.

6. An apparatus as in claim 1, in which the air pump and variable control valve are constructed as an integral unit.

7. An apparatus as in claim 1, in which the variable control valve comprises a manual control member.

8. An apparatus as in claim 1, in which the variable control valve is a solenoid valve which is normally closed and opens in response to an electrical voltage being applied thereto.

9. An apparatus as in claim 8, further comprising an electrical voltage source for applying said electrical voltage to the variable control valve in pulses having a variable pulse width.

10. An apparatus as in claim 9, further comprising means for sensing a speed control member position and an engine speed, the voltage source varying the pulse width in accordance with sensed speed control member position and engine speed.

* * * * *